United States Patent [19]

Owh

[11] Patent Number: 4,595,103

[45] Date of Patent: Jun. 17, 1986

[54] ENVELOPE

[76] Inventor: Yoon C. Owh, 388 Fleetwood Drive, Oshawa, Ontario, Canada, L1K 1C3

[21] Appl. No.: 692,571

[22] Filed: Jan. 18, 1985

[51] Int. Cl.[4] ..... B65D 27/34

[52] U.S. Cl. ..... 206/604; 206/610; 229/DIG. 5

[58] Field of Search ..... 206/610, 604, 484; 229/DIG. 5

[56] References Cited

U.S. PATENT DOCUMENTS

| | | | |
|---|---|---|---|
| 1,098,175 | 5/1914 | Schnitzler | 206/610 |
| 2,067,550 | 1/1937 | Stocks | 206/604 |
| 3,397,835 | 8/1968 | Henning | 206/610 |
| 3,616,990 | 11/1971 | Powell | 206/610 |
| 3,759,439 | 9/1973 | Cross et al. | 206/604 |
| 3,809,220 | 5/1974 | Arcudi | 206/484 |
| 3,939,969 | 2/1976 | Miller et al. | 206/484 |
| 4,011,949 | 3/1977 | Braber et al. | 206/484 |
| 4,332,327 | 6/1982 | Frohwerk et al. | 206/604 |
| 4,386,705 | 6/1983 | Mueller | 229/DIG. 5 |
| 4,411,365 | 10/1983 | Horikawa et al. | 229/DIG. 5 |

*Primary Examiner*—Stephen P. Garbe

*Attorney, Agent, or Firm*—Kenneth M. Garrett

[57] ABSTRACT

In a paper envelope with a tear-off end, the end is substantially severed from the body of the envelope by an elongated slit, and the slit is bridged by an adhering foil preferably selected for its ability to tear along a straight line.

19 Claims, 5 Drawing Figures

FIG.1.
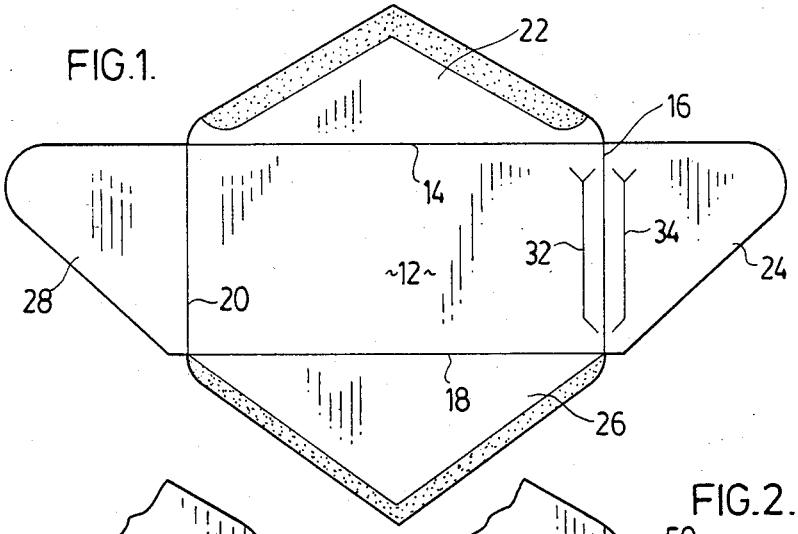
FIG.2.
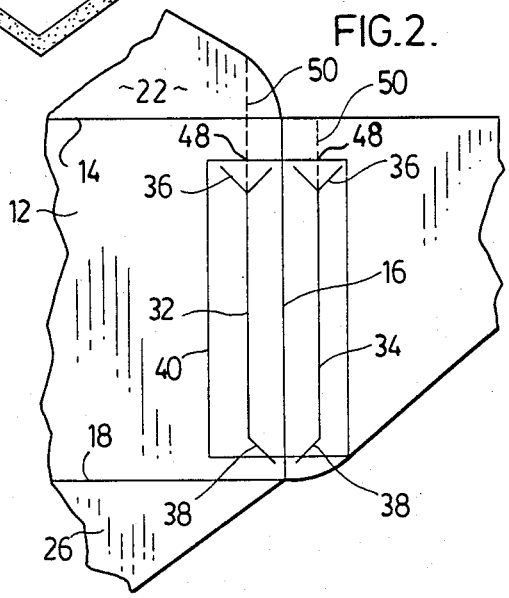
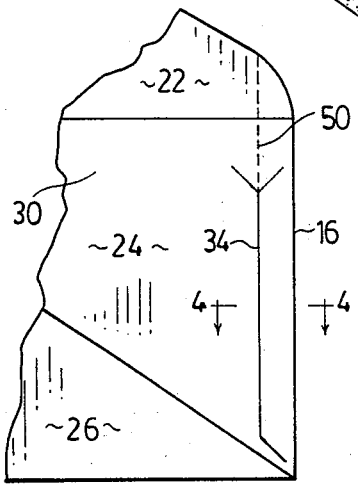
FIG.3.
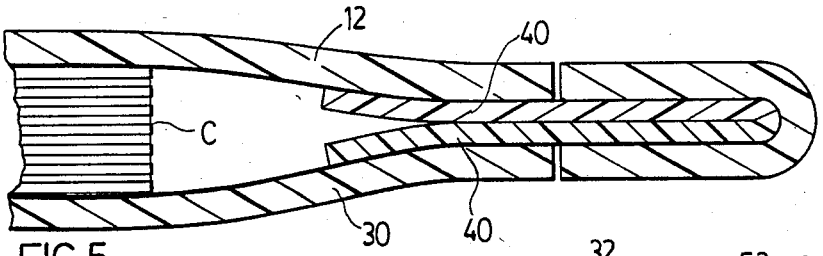
FIG.5.
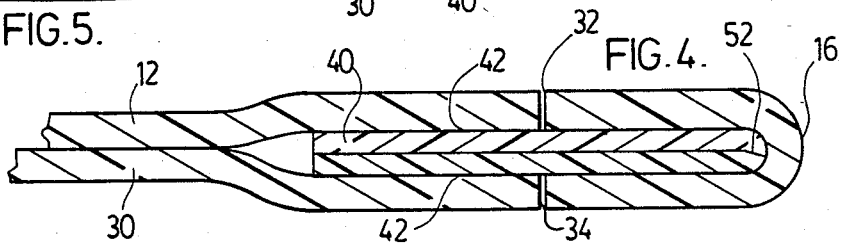
FIG.4.

ENVELOPE

FIELD OF THE INVENTION

This invention relates to an improved envelope construction. It particularly relates to envelopes having a line of weakness therein which facilitates their opening. Such envelopes may be conveniently described as being of a tear-off end type.

BACKGROUND OF THE INVENTION

Many proposals have been made heretofore for improvements in tear-off end envelopes. One early example of such proposals is found in U.S. Pat. No. 211,725 issued Jan. 28, 1879 to Foster, wherein a generally rectilinear line of perforations adjacent an end of the envelope was provided.

In U.S. Pat. No. 3,294,313 issued Dec. 27, 1966 to Spaulding, it was recognized that the perforations permitted the end of the envelope to be bent and flexed on a rectilinear weakening line, whereby the envelope may be accidentaly opened. Spaulding therefore proposed a sinuous line of perforations to overcome this problem.

A further proposal for strengthening the weakened end is found in U.S. Pat. No. 1,098,175 issued May 26, 1914 to Schnitzler, wherein a reinforcing paper strip was adhered to interior surfaces of the envelope to bridge across the perforations. Both single layer and double layer strips were proposed. In that both the reinforcing strip and the envelope in this proposal are made of identical material, i.e. paper, such reinforcing strip appears to defeat the desired object of providing an easily opened tear-off end envelope.

In recent years, post offices have turned increasingly to the use of mechanized handling equipment, and it has become even more necessary to ensure the strength and integrity of envelopes consigned to the general mails. Nonetheless, it is desirable to retain the easy tear-off end feature of envelopes, and also to improve their construction.

The ease of opening of a tear-off end envelope will normally depend upon the closeness of the perforations. Indeed, in another type of envelope wherein the perforations are very closely located, the end may be pulled off with a snap-action. This type of construction is exemplified in FIG. 1 of U.S. Pat. No. 1,180,542, issued Apr. 25, 1916 to Roden, and is generally limited to applications where the contents of the envelope are united with the end of the envelope and are relatively thin, whereby the envelope is unlikely to be caught up in handling machinery. Where the perforations are widely spread apart, the tensile strength required to snap open the tear-off portion of the envelope will increase correspondingly, but the ease with which the end may be torn off will decrease, and the appearance of the body of the envelope from which the end is torn may be somewhat ragged, making the construction less desirable.

It is then, an object of this invention to provide a tear-off end envelope of enhanced strength and durability.

It is another object of this invention to provide a tear-off end envelope which may have a resistance to forces equal to that of the non-perforated end of the envelope, and yet which will tear open along a well formed straight edge.

SUMMARY OF THE INVENTION

In accordance with a broad aspect of the invention, an improved paper envelope construction comprises first and second major surfaces having a bounding edge, with each major surface having a line of weakness therein adjacent the bounding edge, the lines of weakness being generally coincident. A foil material is adhered to each major surface to bridge across the lines of weakness therein.

Preferably, the foil material is a thermoplastic film, which will tear relatively easily along the length thereof, and yet which has a tensile strength at least equal to that of paper.

The line of weakness desirably comprises an axially elongated slit which extends substantially along the length of each major surface adjacent the bounding edge, but which does not communicate with a bounding edge of the envelope, at least at the upper end thereof at which the tear is usually started; such slit may be otherwise referred to as a blind slit. The slit may be continuously formed, although it is not precluded that it be interrupted by one or more small tongues along its length; however, no advantage is seen in providing such tongue or tongues.

The slit is covered by a strip of foil material, amongst which materials may be exemplified plastic foils and metallic foils. Generally such foils will have a thickness in the range of about 0.025 mm to about 0.04 mm. Preferred thermoplastic foil materials are found to tear easily along a rectilinear line in one direction only, and in this sense may be referred to as having a grain. Preferably, foil strips are used which are oriented whereby their major axis lays along the grain. Particularly preferred foil materials are those sold in commerce and which are referred to as laminating foils. Such foils have one surface thereof which has a surface layer or coating which fuses at a lower temperature than the body of the foil, and which when heated so as to cause the surface layer or coating to melt, will adhere strongly to a paper substrate to which it is applied.

While such foils tear easily and uniformly, at least along the grain, it is difficult to initiate a tear. For this reason the strips are provided with a tear starter. Such tear starter may be conveniently formed by perforating the foil at the edge at which it is desired to commence the tear; preferably such perforation will also pass through the major surfaces of the envelope, and will extend along a line which communicates with, or adjacent to, an edge of the envelope.

The invention will be further described in relation to a preferred embodiment thereof, from which other objects and advantages of the invention may well be discerned.

BRIEF DESCRIPTION OF THE DRAWINGS

FIG. 1 is a plan view of an envelope blank for use in the invention;

FIG. 2 shows a portion of FIG. 1 an enlarged scale, at a later stage of the manufacture;

FIG. 3 shows a plan view of a portion of the finished envelope;

FIG. 4 is a cross section along 4—4 of FIG. 3; and

FIG. 5 is similar to FIG. 4, but shows the envelope with its contents.

DESCRIPTION OF THE PREFERRED EMBODIMENT

Considering now the drawings in detail, an envelope blank in accordance with the invention is identified in FIG. 1 generally by the numeral 10, and comprises a first, generally rectangular major surface portion 12, bounded by crease lines 14, 16, 18, 20 which will ultimately define the margins of the envelope. Flaps 22,24,26,28 are unitarily formed with major surface portion 12, the flaps, when folded together, forming the other major surface portion 30 of the envelope, as seen in FIG. 3.

As best seen in FIG. 2, a pair of axially elongated slits 32, 34 are formed in blank 12 to be equidistant from crease line 16 and parallel thereto. Slits 32, 34 extend uninterrupted along substantially the width of the blank, taken at crease line 16. The upper end of the slits 32, 34 is bifurcated in a V form at 36, and terminates conveniently about 1 cm from the upper margin 14 of the envelope. The lower end of the slits 32,34 is angled towards crease line 16 at 38.

A strip of laminating foil 40 is fused to the envelope blank 10 at interface 42 perferably on what will ultimately become the interior surface thereof. Foil 40 is oriented so as to tear uniformly from top to bottom, in the sense of the illustration and also that of the envelope construction. Foil 40 has a transverse width such that it bridges across each of slits 32, 34. It has an axial length such that it terminates at the upper end 44 at about the upper extremity of the V bifurcations 36, and at the lower end 46 thereof at about the lower extremity of the angled slits 38, generally sealing the slits.

A series of perforations 50 is punched through both major surfaces 12, 30 of the envelope to be generally collinear with slits 32, 34 and to puncture foil 40 at the upper end 44 thereof at 48, thereby forming the tear starter. The perforations may be punched in the blank 10 at the time of formation of the blank, in which case a tear starter will be separately formed in the upper end of the foil 40.

When envelope blank 10 is folded, as in FIG. 3, it is preferably thermally treated under pressure adjacent margin 16, so as to set a sharp crease 52 in foil 40. The bonding of the paper of the envelope and the foil tends to stiffen the construction adjacent edge 16 if the envelope, thereby preventing the major surfaces 12 and 30 of the envelope from spreading apart when the envelope is stuffed with its contents C, as seen in FIG. 5. As a corollary, the contents of the envelope is precluded from approaching too closely to the tear-off edge 16, hence it does not interfere with the tear-off action.

While the method of using the invention has not been specifically set forth, it is believed that this will be generally apparent from the foregoing description and in the light of the prior art. To initiate the tearing of end 16 of the envelope, the upper left hand corner of the envelope, as seen in FIG. 3, is peeled downwardly along the line of perforations 50. The bifurcation 36 formed at the upper end of slits 32, 34 acts to accomodate any misalignment of perforations 50 and the slits 32, 34 which might otherwise permit the tear to continue along other than the slit line. Angled slit 38 directs the tear towards the lower corner of the envelope. It will be apparent that other means for initiating the tearing of the envelope could be provided and that foil 40 could be coextensive with the length of the envelope along crease 16.

While in the foregoing specification reference has been made throughout to the "end" of an envelope, it is not intended to restrict the placement of the tear-off construction to any particular edge of the envelope.

The foregoing is exemplary only of the preferred embodiment of the invention. It is apparent that many changes may be made thereto within the spirit of the invention as claimed in the accompanying claims.

I claim:

1. A paper envelope comprising first and second major surfaces having a bounding edge, each major surface having a line of weakness therein adjacent said bounding edge, with said lines of weakness being generally coincident; and a a thermoplastic foil strip having a fold thermally set therein adhered to each major surface to bridge across said line of weakness therein with said fold coincident with said bounding edge.

2. A paper envelope as defined in claim 1 wherein said foil strip is fusibly adhered to said major surfaces.

3. A paper envelope as defined in claim 1 wherein said line of weakness comprises a generally continuous slit extending substantially along the length of each said major surface taken at said bounding edge.

4. A paper envelope as defined in claim 3 wherein said major surfaces have transverse edges joining said bounding edge, and wherein said slit terminates prior to meeting at least one of said transverse edges.

5. A paper envelope as defined in claim 4 wherein said major surfaces are provided with perforations which extend generally from an edge thereof to a point proximate said slit.

6. A paper envelope as defined in claim 5 wherein said slit where proximate said perforations is branched outwardly on each side of said perforations.

7. A paper envelope as defined in claim 1 wherein said foil strip is punctured adjacent an edge thereof transversley oriented with respect to said line of weakness.

8. A paper envelope comprising front and rear faces joined together along a bounding edge; each said face having a blind slit therein adjacent said bounding edge, and a thermoplastic foil strip folded and theramally set along the length thereof adhered to the interior surfaces of said front and rear faces to bridge over said slit in each face.

9. A paper envelope as defined in claim 8 wherein said foil strip is a laminating foil.

10. A paper envelope as defined in claim 9 wherein said foil strip is provided with a tear starter adjacent at least one transverse edge thereof.

11. A paper envelope as defined in claim 10 wherein said envelope is provided with a perforation line which extends from a point adjacent an edge thereof to a point adjacent said slit.

12. A paper envelope as defined in claim 11 wherein said slit is bifurcated proximate said perforations.

13. A paper envelope as defined in claim 8 wherein said foil strip is a thermoplastic material having a grain, and is arranged with the grain parallel to said bounding edge.

14. A paper envelope comprising front and rear faces joined together along a bounding edge thereof; each said face having a blind slit therein adjacent said bounding edge, said slits being generally coincident;

a foil strip adhered to each face to seal over said slits, and a line of perforations extending from a point adjacent an edge of said envelope to a point adjacent one end of said slits.

15. A paper envelope as defined in claim 14, wherein said foil strip is a thermoplastic material having a grain, and is arranged with said grain parallel to said slits.

16. A paper envelope as defined in claim 14, wherein said foil strip is a thermoplastic material having a fold thermally set therein, said fold locating substantially at said bounding edge.

17. A paper envelope as defined in claim 14, wherein said slits are bifurcated at the end thereof adjacent said line of perforations.

18. A paper envelope as defined in claim 14, wherein said slits are continuous and extend substantially along the length of each of said front and rear faces taken at said bounding edge.

19. A paper envelope as defined in claim 14, wherein said perforations penetrate said foil strip to form a tear starter therefor.

* * * * *